US010429085B2

(12) United States Patent
Czarko

(10) Patent No.: US 10,429,085 B2
(45) Date of Patent: Oct. 1, 2019

(54) METHOD OF OPERATION OF THE INSTALLATION OF SANITARY HOT WATER AND INSTALLATION OF SANITARY HOT WATER

(71) Applicant: Zbigniew Tadeusz Czarko, Lublin (PL)

(72) Inventor: Zbigniew Tadeusz Czarko, Lublin (PL)

( * ) Notice: Subject to any disclaimer, the term of this patent is extended or adjusted under 35 U.S.C. 154(b) by 0 days.

(21) Appl. No.: 15/526,567

(22) PCT Filed: Nov. 13, 2015

(86) PCT No.: PCT/IB2015/058782
§ 371 (c)(1),
(2) Date: May 12, 2017

(87) PCT Pub. No.: WO2016/075665
PCT Pub. Date: May 19, 2016

(65) Prior Publication Data

US 2017/0314790 A1 Nov. 2, 2017

(30) Foreign Application Priority Data

Nov. 13, 2014 (PL) ..... P.410133

(51) Int. Cl.
*F22B 29/02* (2006.01)
*F24D 19/10* (2006.01)
*F24D 17/00* (2006.01)

(52) U.S. Cl.
CPC ..... *F24D 19/10* (2013.01); *F24D 17/00* (2013.01); *F24D 17/0094* (2013.01); *F24D 19/1051* (2013.01)

(58) Field of Classification Search
CPC ..... B60H 1/0034; B60H 2001/00307; F24H 1/08; F22B 29/02
See application file for complete search history.

(56) References Cited

U.S. PATENT DOCUMENTS 6,823,878 B1 * 11/2004 Gadini ..... A47L 15/4229 134/109
8,491,786 B2 * 7/2013 Kim ..... B67D 1/0004 210/104

(Continued)

FOREIGN PATENT DOCUMENTS

DE 29900274 U1 4/1999
DE 102004019533 A1 7/2005

OTHER PUBLICATIONS

International Search Report issued for PCT/IB2015/058782 dated Feb. 24, 2016.

(Continued)

*Primary Examiner* — Gregory A Wilson
(74) *Attorney, Agent, or Firm* — Westman, Champlin & Koehler, P.A.; Z. Peter Sawicki; Amanda M. Prose

(57) ABSTRACT

The invention solves the problem of hot water flow in a domestic hot water installation. The subject of the installation according to the invention is that on a third cold water branch (13) that feeds the heating device (1) a control switch (4) is installed, said switch (4) is connected by control system (11) with hot water flow forcing device (3) set on a second hot water circulation branch (2).

1 Claim, 2 Drawing Sheets

(56) References Cited

U.S. PATENT DOCUMENTS

| | | | | |
|---|---|---|---|---|
| 2005/0097913 | A1* | 5/2005 | Hess | A23G 9/045 62/340 |
| 2009/0178192 | A1* | 7/2009 | Vassilev | E03C 1/232 4/668 |
| 2016/0311702 | A1* | 10/2016 | Hartig | B01D 61/142 |

OTHER PUBLICATIONS

Written Opinion of the International Searching Authority issued for PCT/IB2015/058782 dated Feb. 24, 2016.

* cited by examiner

METHOD OF OPERATION OF THE INSTALLATION OF SANITARY HOT WATER AND INSTALLATION OF SANITARY HOT WATER

CROSS-REFERENCE TO RELATED APPLICATIONS

This application is a Section 371 National Stage Application of International Application No. PCT/IB2015/058782, filed Nov. 13, 2015, and published as WO/2016/075665 A1 on May 19, 2016, which claims priority to and benefits of PL Patent Application Serial No. P.410133, filed with the Patent Office of the Republic of Poland on Nov. 13, 2014, the entire contents of which are incorporated herein by reference.

TECHNICAL FIELD

The subject of the invention is the method of operation of the installation of sanitary hot water and installation of sanitary hot water.

BACKGROUND

In known installations of hot water, in order to obtain, after opening the tap, water at a desired temperature it was required to maintain the continuous water circulation or control the power of the pump actuating the circulation by means of a timer or a temperature sensor.

The device is known, for example from Polish patent description P.182897, that regulates the temperature of domestic hot water where a temperature sensor is placed in the secondary circuit of the heat exchanger, said sensor is placed on the outlet side of the heat exchanger. The sensor is connected with a regulator, and on the feeding pipe of the secondary heat circuit there is a flow sensor for detection of momentary water flow changes.

Turbine flowmeter is also known from published Polish patent description No. P.110740, that consist of a body, bearing a rotary wheel with paddles, and permanent magnet pulse generator. Pulse generator consists of annular permanent magnet set on the shaft of the rotor and a magnetic field sensor, where both those elements are set close to each other inside of the body, while the magnetic field sensor is connected with a flow volume meter placed outside of the body.

A method for enforcing hot water circulation is known from patent description No. DE19600465, characterized in that the sensor placed in the hot water circulation pipe detects the movement of water in the pipe, and on that basis an impulse to turn the pump on is generated. The hot water installation is characterized in that the sensor detecting the flow of water is a flowmeter, ultrasonic sensor, pressure sensor or a sensor to detect pressure changes and is installed in the hot water pipe, and the impulse to turn the pump on generator is a time switch.

SUMMARY

According to the invention the method of operation of the installation of sanitary hot water is that in the moment of opening of hot water tap a circulation in the hot water branch is initialized, where the consumption of the water is detected on the cold water branch that feeds the heating device, by a flow detection device, said flow detection device is a controller switch installed on the cold water branch.

Forcing the hot water circulation is stopped after closing the tap. Forcing of water circulation can also be stopped after set time, or after reaching certain temperature of the water, set on the sensor.

The solution according to the invention contributes to preservation of energy required to heat the water, by lowering the time required to obtain hot water in the water supplying unit thanks to the installment of flow sensing device on the cold water branch.

The subject of the invention is also the installation of sanitary hot water. Subject matter of the invention is that in the third cold water branch, that enters the heating device, there is a control switch installed, connected with a device that forces the flow of hot water installed on the second branch of hot water circulation. The control switch has an element, that is activated mechanically by means of water flow, which is coupled by the water flow sensor with control system.

DETAILED DESCRIPTION

Installment of the control switch on the cold water entering the device that prepares domestic hot water allows for the work of the control device only by detection of water flow independent of temperature or set time, and eliminates random activations of control switch and consequently undesired work of accelerating device, which may result from difference of pressures, temperatures or undesired water gravitation. Besides that, the worktime of power supplies of heating device is lowered, which causes further saving of electrical energy and water, and also prolongs the service life of the power supply. Thanks to installment of the control switch on cold water entering the device that prepares the hot domestic water the materials with lower technological requirements (cheaper, more eco-friendly) can be used in production of the switch. Such installment improves the operation of a hot water circulation system, and does not impede the operation of a DHW control system and co-operating devices. Abovementioned solution also has an advantage, that no residues precipitated in the process of water heating deposit on the water flow activated element, which significantly extends its service life and impacts its operation.

Example 1

On the Method

Figure 1:
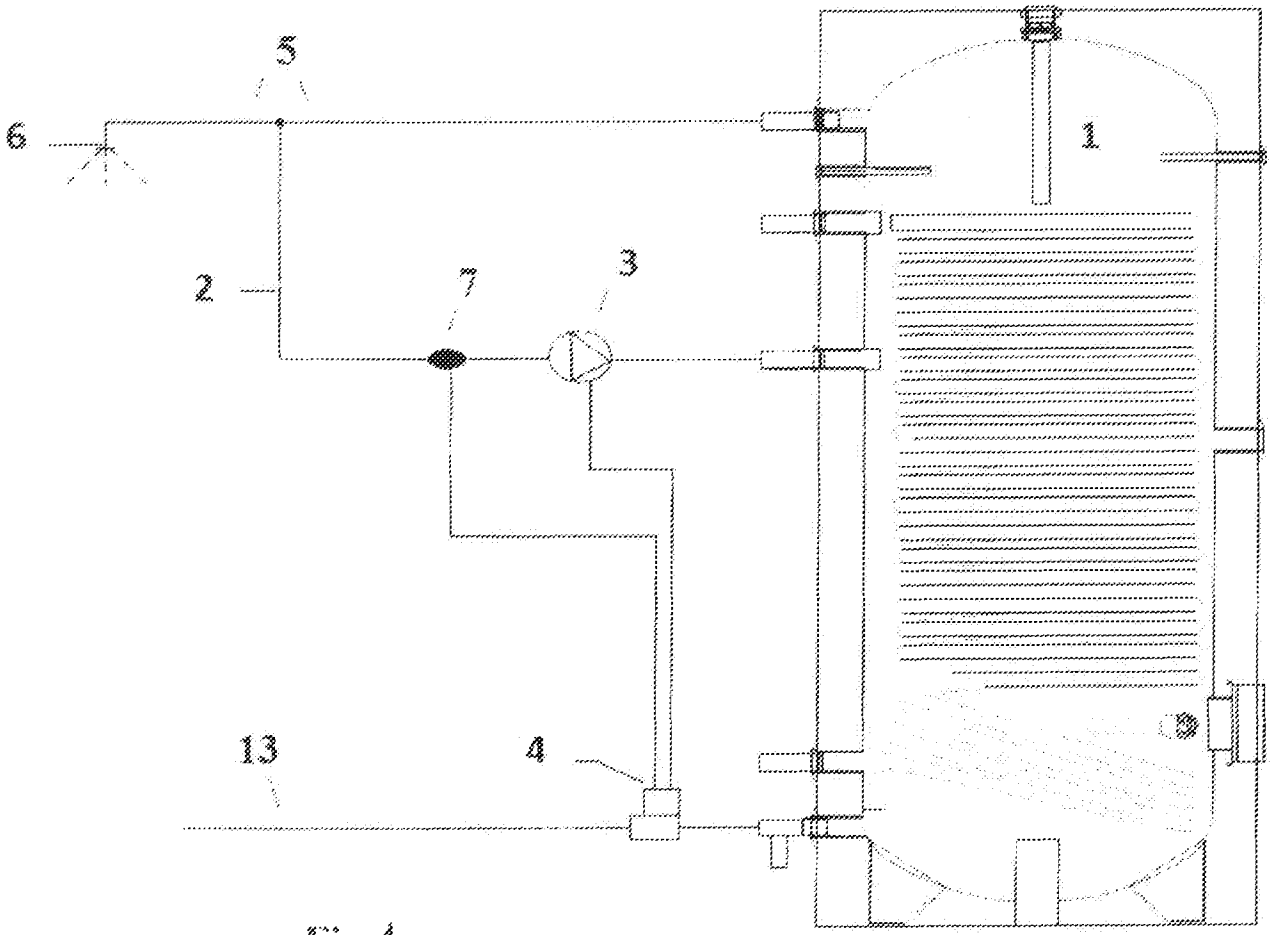
FIG. 1 is a schematic view of an installation described herein.

The method of operation of the installation is additionally explained on schematic on FIG. 1, said installation has three branches 5, 2, 13. There are two hot water branches 5 and 2 which include a hot water circulation branch 2 and a hot water collection branch 5, and third branch is a cold water intake branch 13. In the third branch 13, on the inlet to heating device 1, control switch 4 is installed, and on the hot water circulation branch 2 a pump 3 is installed. Opening of a tap 6 causes the flow of water in the third cold water intake branch 13, which is detected by control switch 4. Water flow activates the control switch 4, which activates the pump 3 installed on the hot water circulation branch branch 2. Pump 3 causes the circulation of hot water also in the hot water collection branch 5, thus accelerating the arrival of water with desired temperature to tap 6.

Example 2

Regarding the Device

Figure 2:
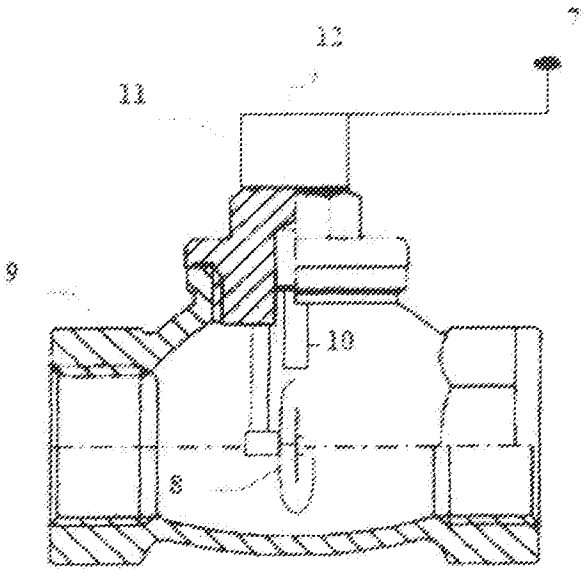
FIG. 2 is a schematic of a control switch.

Example of hot water installation according to the invention is shown on the drawings, where FIG. 1 shows schematic diagram of the installation with control switch installed on the inlet of the exchanger, and FIG. 2 shows schematics of control switch.

A hot water circulation branch 2 is connected to heating device in form of heat exchanger 1, said branch 2 having a pump 3 forcing the flow of water in the branch 2. On the inlet to the heat exchanger 1 there is a control switch 4 electrically connected with pump 3. On the hot domestic water collection branch 5 there is a tap 6, Additionally, on the hot water circulation branch 2, before the inlet of circulating water to heat exchanger 1, first water temperature sensor 7 is installed. Control switch 4 has a turbine 8 set inside of the body 9. Turbine 8 is coupled by the second water flow sensor 10 with control system 11 equipped with the timer 12. The first temperature measuring sensor 7 is connected to the control system 11. As shown on FIG. 2, control switch 4 is placed on the third cold water branch 13 to the exchanger 1.

When the water flow is set by tap 6 movement of hot water in water collection branch 5 and third cold water branch 13 is started, that feeds the device 1 that prepares hot domestic water. Movement of the water forces the rotation of turbine 8, that activates sensor 10, that sends the signal to electronic system 11, which activates pump 3. The operation time of the pump 3 is regulated by timer 12 or electrical system 11. Electrical system 11 has the task to control further need for work of pump 3 by water flow. After set time passes or when there is no water flow through switch 4, or when the water in the hot water circulation branch 2 reaches desired temperature set on sensor 7, pump 3 is turned off.

The invention claimed is:

1. An installation of sanitary hot water that has a water heating device, a water flow forcing device in a hot water circulation circuit, a control switch that reacts to a flow of liquid installed on a cold water branch that feeds the water heating device and a temperature sensor characterized in that the control switch is installed, said switch comprising an element in the form of a small turbine that is activated under the influence of water flow, coupled by the temperature sensor with a control system, which is connected with the water flow forcing device set in a hot water circulation branch and the temperature sensor is installed in the hot water circulation branch between the water flow forcing device and a water collection branch of the hot water circulation circuit.

* * * * *